US005095981A

United States Patent [19]

Mikolajczyk

[11] Patent Number: 5,095,981

[45] Date of Patent: Mar. 17, 1992

[54] CASING CENTRALIZER

[76] Inventor: Raymond F. Mikolajczyk, P.O. Box 51384, Lafayette, La. 70505

[21] Appl. No.: 610,772

[22] Filed: Nov. 8, 1990

Related U.S. Application Data

[63] Continuation of Ser. No. 924,929, Oct. 30, 1986, abandoned, which is a continuation-in-part of Ser. No. 704,489, Feb. 22, 1985, abandoned.

[51] Int. Cl.[5] ..... F21B 17/10

[52] U.S. Cl. ..... 166/241.6

[58] Field of Search ..... 166/241, 172, 174, 175; 175/41, 325; 250/260

[56] References Cited

U.S. PATENT DOCUMENTS

| | | | |
|---|---|---|---|
| 1,460,632 | 7/1923 | Wigle et al. | 166/241 |
| 2,388,416 | 11/1945 | Johnson | 166/241 |
| 2,424,027 | 7/1947 | Gist | 166/241 |
| 2,659,439 | 11/1953 | Baker | 166/241 |
| 2,715,552 | 8/1955 | Lane | 175/325 |
| 2,973,996 | 3/1961 | Self | 175/325 |
| 3,045,767 | 7/1962 | Klassen | 175/325 X |
| 3,276,824 | 10/1966 | Carter | 175/325 |
| 3,762,472 | 10/1973 | Alexander, Jr. | 166/241 |
| 3,825,081 | 7/1974 | McMahon | 175/73 |
| 3,916,998 | 11/1975 | Bass, Jr. et al. | 175/325 X |
| 3,963,075 | 6/1976 | Evans | 166/241 |
| 4,081,203 | 3/1978 | Fuller | 175/325 |
| 4,197,879 | 4/1980 | Young | 166/324 |
| 4,275,935 | 6/1981 | Thompson et al. | 166/241 X |
| 4,396,234 | 8/1983 | Garrett | 175/325 |
| 4,600,063 | 7/1986 | Beasley | 166/241 X |
| 4,984,633 | 1/1991 | Langer et al. | 166/241 |

FOREIGN PATENT DOCUMENTS

| | | | |
|---|---|---|---|
| 1032867 | 6/1978 | Canada | 166/241 |
| 709799 | 1/1980 | U.S.S.R. | 166/241 |
| 2134947 | 8/1984 | United Kingdom . | |

*Primary Examiner*—David J. Bagnell
*Attorney, Agent, or Firm*—Vaden, Eickenroht, Thompson & Boulware

[57] ABSTRACT

There is disclosed a casing centralizer which comprises a tubular body or sleeve adapted to fit about a joint of casing, and blades extending longitudinally along the outer diameter of the sleeve in generally equally spaced apart relation, with the body and blades being cast as one metal piece.

4 Claims, 2 Drawing Sheets

CASING CENTRALIZER

This application is a continuation of my copending application, Ser. No. 924,929, filed Oct. 30, 1986, and entitled "Casing Centralizer" (now abandoned), which is in turn a continuation-in-part application of my copending application, Ser. No. 704,489, filed Feb. 22, 1985, and entitled "Casing Centralizer Stabilizer" (now abandoned).

This invention relates generally to the completion of oil and gas wells wherein one or more strings of casing are "cemented" within the well bore. More particularly, it relates to an improved casing centralizer of the type which is adapted to be installed about a joint of casing in order to hold it in a centered position within the well bore or an outer casing in which the joint is disposed.

In the completion of such wells, a cement slurry is pumped downwardly within each casing string and upwardly within the annulus thereabout, and thus between the well bore and the outermost string or between an inner string and the next outer string. Desirably, the cement column is of substantially uniform thickness about the string, and, in any event, the string should not lay up against the side of the well bore or outer string, because, in this latter case poor cement covering will allow detrimental fluid to migrate up the annulus through the cemented section and thus not be confined within the well bore. It is therefore common practice in the industry to hold the casing string in a centered position by means of so called casing centralizers spaced along the length of the string.

Casing centralizers are more often of a construction which includes a tubular body or sleeve adapted to fit closely about one or more casing joints along the length of the string. In a commonly used casing centralizer of this type, outwardly bowed springs are connected at their opposite ends to the body. Although the resiliency of the bow springs enables them to move through restrictions in a well bore, they may not support the weight of the casing, especially in a highly deviated well bore and/or leaning conditions in a substantially vertical well bore. Hence, the springs on the low side of the well bore may collapse to permit the casing to lay up against it and thus prevent complete cement encirclement.

In another common casing centralizer, the bow springs are replaced by solid strips of metal which are tapered at each end to provide circumferentially outer spaced bearing surfaces for engaging the well bore or outer casing. Although less prone to collapse than bow springs under the weight of the casing, these strips are often not strong enough to prevent bending along a mid point upon encountering an obstruction in the well bore. As a result, they may become wedged in the well bore, and, in any case, are no longer suitable for centering the casing.

It is often desirable to be able to determine the depth of a particular casing joint or marker relative to the depth of the well bore and thus that of the formation to be produced. For this purpose, it has been proposed to mount collars having magnetic elements on the casing to provide magnetic fields which may be detected by means of conventional wireline operated logging tools lowered into the casing string. These markers were unreliable and are no longer used.

In some cases, such as large diameter casing in a relatively soft formation at the upper end of a well bore, it may not be possible or at least impractical to provide a single centralizer with the sufficient bearing surface to support a joint of casing. Thus, for example, the centralizer would have to be so long as to make it too expensive to manufacture or handle. In this case, two or more centralizers may be mounted about the joint of casing, preferably with the spaces or channels between blades or other vertically aligned centering elements to prevent clogging or "balling".

It is therefore an object of this invention to provide a casing centralizer which, like those above described, may be disposed about a casing joint, but which is of sufficiently rigid construction as to prevent collapse or bending, and yet not unduly restrict the flow of a cement slurry therepast.

Another object is to provide such a casing centralizer which may be firmly secured in a fixed position with respect to the casing joint.

Still another object is to provide such a casing centralizer which is very inexpensive to manufacture.

Yet another object is to provide a centralizer which may be so mounted relative to another of a pair of centralizers as to automatically rotationally align the spaces between their blades.

It is a still further object of this invention to provide a casing centralizer which permits detection of the depth of the casing in a more reliable manner and without the need for a separate marker.

These and other objects are accomplished, in accordance with the illustrated embodiments of this invention, by a casing centralizer which includes a sleeve or tubular body adapted to fit closely about a joint casing, and a plurality of blades extending longitudinally along the outer diameter of the sleeve in equally spaced apart relation. More particularly, each blade has opposite sides and ends which are tapered outwardly toward one another, and a relatively wide outer surface for bearing against the well bore or an outer casing in which the casing is disposed. Thus, the centralizer is sufficiently strong to prevent collapse or bending out of shape, and instead will maintain the outer bearing surfaces in position to engage the well bore or an outer casing and enable the string to be raised or lowered through obstructions in the well bore. At the same time, the spaces between the blades provide sufficient cross sectional area for the passage of the cement slurry to minimize clogging during running and cementing. Preferably, the body and blades are mold cast as one metal piece, thereby permitting them to be manufactured in less time and at less cost than would be possible if the blades were instead welded to the body.

Although it is contemplated that the centralizer may be free to move vertically along and/or rotate with respect to the casing, set screws extend threadedly through holes in at least certain of the blades and the sleeve for gripping the casing in the event it is desired to fix the centralizer with respect to the casing. Preferably, and as illustrated, the said screws extend threadedly through holes which open onto the bearing surface, and thus provide a maximum thread length for connection to the screws.

Still further, an insert of radioactive material is mounted in the sleeve or body near its inner diameter, and thus in a position to be sensed by a wire line logging tool. For this purpose, holes are drilled through one of the blades and the sleeve and the radioactive material is mounted in place adjacent the inner end of the hole in the sleeve.

In accordance with an alternative embodiment of the invention, one end of the tubular body has recesses longitudinally aligned with the spaces between adjacent blades, and the other end of the tubular body has recesses longitudinally aligned with the blades. More particularly, the recesses and portions of the bodies which extend longitudinally beyond the recesses of substantially equal width, whereby the longitudinally extending portion of a pair of centralizers may be inserted between the recesses in their adjacent ends in order to rotationally interlock the pair with the spaces between their blades longitudinally aligned. Preferably, the recesses in each end are of the same depth, and the blades extend from the outer ends of the recesses in the other end, whereby the blades extend continuously along the lengths of the pair to provide maximum bearing area.

In the drawings, wherein like reference characters are used throughout to designate like parts:

Figure 4:
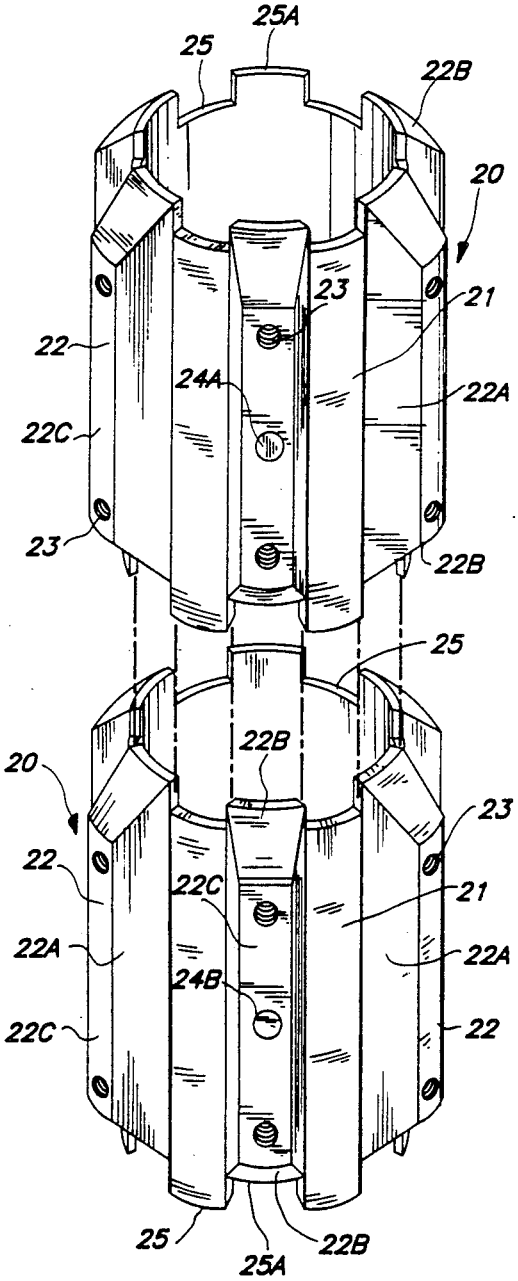
Figure 5:
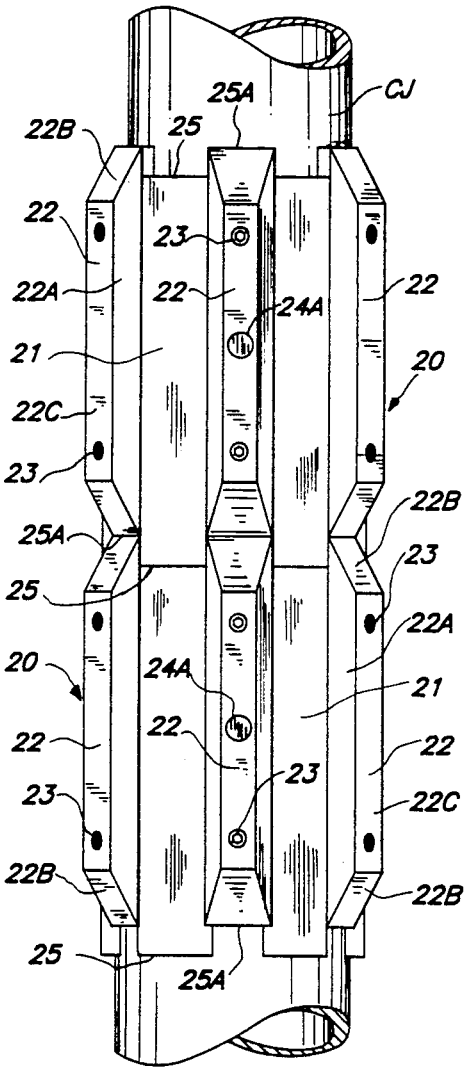

FIG. 4 is a perspective view of a pair of centralizers constructed in accordance with another embodiment of the present invention wherein each centralizer is adapted to be moved into rotationally interlocking relation with the other in end to end relation; and FIG. 5 is an enlarged elevational view of the pair of centralizers of FIG. 4 installed about a joint of casing in rotationally interlocked relation.

Figure 1:
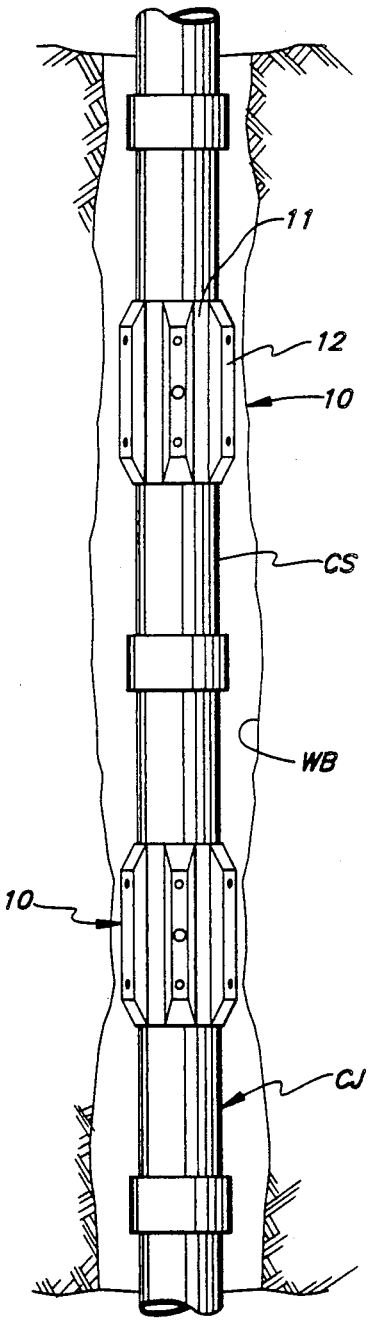
FIG. 1 is a vertical elevational view of a casing string within a well bore and showing a centralizer constructed in accordance with the present invention disposed about adjacent joints of the casing string.

As shown in FIG. 1, the well bore WB is substantially vertical, although it will be understood that it may deviate a rather substantial amount with respect to the vertical. Also as can also be seen from FIG. 1, the diameter of the well bore is uneven throughout its length, with restricted areas at random points along its length. The casing string CS is made up of a plurality of casing joints CJ, each having a box at one end and a pin at the other end for connection to adjacent joints making up the string.

Figure 2:
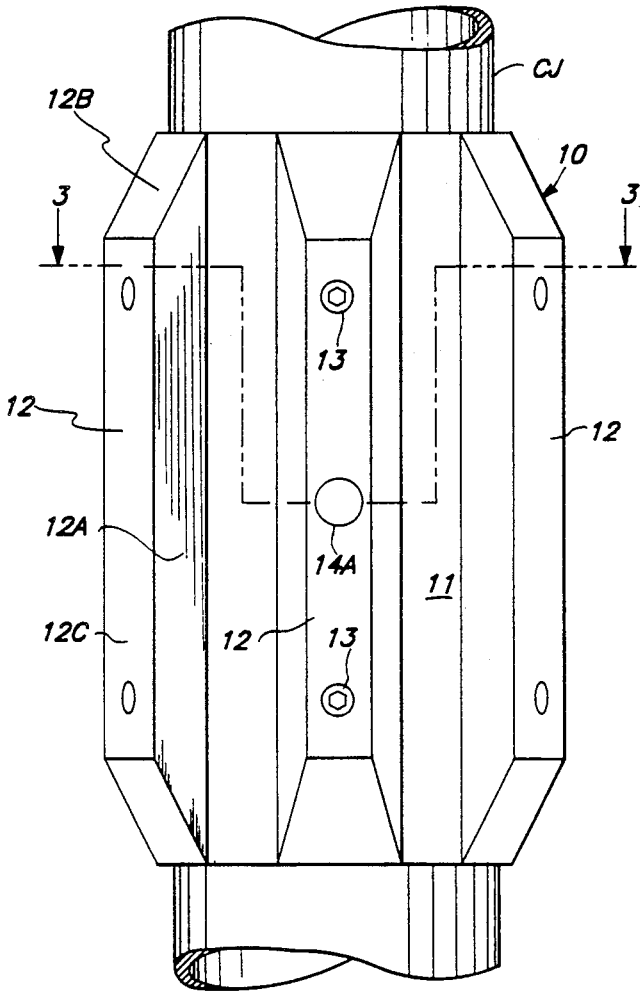
FIG. 2 is an enlarged elevational view of one of the centralizers of FIG. 1.
Figure 3:
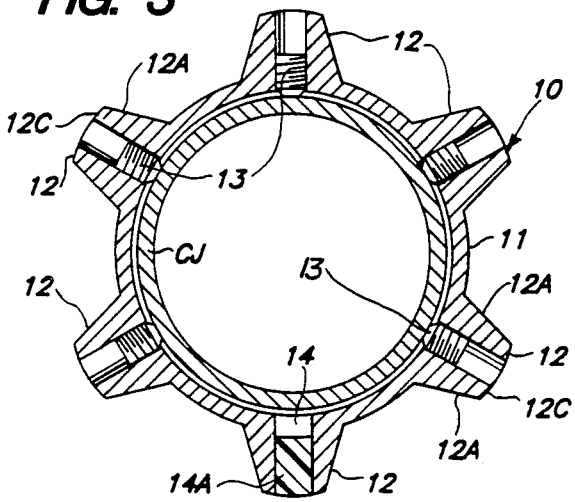
FIG. 3 is a cross sectional view of the centralizer, as seen along broken lines 3—3 of FIG. 2.

Each of the centralizers constructed in accordance with the first described embodiment shown in FIGS. 1 to 3, and indicated in its entirety by reference character 10, is disposed about a casing joint for maintaining the joint substantially centered within the well bore so that a cement column of substantially even thickness may form about the casing. It will be understood that the number and spacing of the centralizers along the length of the casing string may vary at the will of the operator of the well.

In any event, each such centralizer 10 includes a sleeve or tubular body which is adapted to fit closely about the casing joint, as best shown in FIG. 3. More particularly, in the illustrated and preferred embodiment of the invention, the sleeve is of circumferentially continuous construction, so that, in order to assemble the centralizer on a casing joint CJ, the sleeve is slipped over the pin end of the joint prior to make up of the pin with a box end of an adjacent casing joint.

As previously described, each centralizer also includes a plurality of blades 12 which are cast as one metal piece with the body and extend longitudinally along the outer diameter of the sleeve in generally equally spaced apart relation. As shown, the blades extend for substantially the full length of the sleeve.

As also previously described, the opposite sides 12A of the blades as well as the opposite ends 12B thereof are tapered outwardly toward one another and intersect the edges of a relatively large bearing surface 12C adapted to engage the well bore or outer casing to maintain the casing substantially centered therein. As will be appreciated, the tapered ends 12B of the blades facilitate movement of the centralizer vertically though obstructions in the well bore. The tapered sides 12A of the blades, on the other hand, provide a wide open area between adjacent blades for the flow of cement slurry therepast.

In the illustrated and preferred embodiments of the invention, the centralizer is secured to the casing joint CJ at a desired position along the length thereof by means of set screws 13. As best shown in FIG. 3, each set screw extends threadedly through holes in both the blade and the sleeve so as to bear tightly against the outer diameter of the casing joint CJ. Since the screws extend through the thickest portion of the blade, they have the largest possible threaded connection thereto. As shown, two set screws extend through each blade generally adjacent each end of the blade. If, on the other hand, the centralizer is not secured to the casing joint so that it is free to rotate with respect thereto, its axial movement may be limited by stop collars at one or both ends.

As also best shown in FIG. 3, additional holes are drilled through one blade and the sleeve, and an insert of radioactive material 14 is mounted within the inner end of the hole near the inner diameter of the sleeve 11. The outer end of the hole is preferably filled with a sealant body 14A of plastic or cement. As above described, this provides a radioactive field which may be detected by a conventional wire line logging tool within the casing joint CJ.

Each of the centralizers 20 constructed in accordance with the alternative embodiment of the invention shown in FIGS. 4 and 5 is similar to the centralizer 10 described in connection with FIGS. 1 to 3 in that it comprises a tubular body 21 adapted to fit closely about a casing joint CJ, as shown in FIG. 4, and a plurality of blades 22 which extend longitudinally along the outer diameter of the body in generally equally spaced apart relation. More particularly, and as in the first described embodiment, the body is of circumferentially continuous construction, and is cast as one metal piece with the blades. The spaces between the sides of adjacent blades allow ample fluid passage, and the outer surfaces of the blades are sufficiently wide to provide adequate bearing surfaces for engaging the wall of the well bore in order to centralize the casing string.

As also previously described in connection with the embodiment of FIGS. 1 to 3, the sides 22A of the blades are tapered outwardly toward one another and intersect the edges of the bearing surface 22C on the outer diameter of the blades. The ends 22B of the blades are also tapered outwardly toward one another so as to facilitate movement of the centralizer vertically through obstructions in the well bore.

Each of the centralizers 20 is adapted to be secured to the casing joint CJ by means of set screws 23 which, as described in connection with FIG. 3 of the first described embodiment of the invention, extend threadedly through holes in both the blade and the body so as to bear tightly against the outer diameter of the casing joint. As shown in FIGS. 1 to 3, there are two sets of set screws which extend through each end of the blade.

As also described in connection with the embodiment of FIGS. 1 to 3, an additional hole is drilled through one blade and sleeve of each centralizer and an insert of radioactive material is mounted within the inner end of the hole in the body near the inner bore diameter, as shown in FIG. 3. The outer ends of the hole is preferably filled with a body 24A of plastic or cement. The function of the inserts is, of course, as described in connection with the first embodiment of the invention.

As also previously described, each of the centralizers 20 differs from the centralizer 10 in that one end of the tubular body 21 thereof has recesses 25 longitudinally aligned with the spaces between adjacent blades, and the other end thereof has recesses 25A longitudinally aligned with the blades. More particularly, these inserts and portions of the body which extend longitudinally beyond the recesses are of substantially the same width so that the portions of a pair of centralizers may be inserted between the recesses in their adjacent ends in order to rotationally interlock the centralizers with the spaces between their blades longitudinally aligned. Thus, with the pair of centralizers arranged, as shown in FIG. 4, with the blades and spaces between them are longitudinally aligned with one another, the longitudinally extending portions and recesses on their adjacent ends may be moved into the interlocking position, as shown in FIG. 5, whereby each centralizer is prevented from rotational movement out of position in which the spaces between its blades are longitudinally aligned with spaces between the blades of the other centralizer.

For this purpose, one of the centralizers may be moved into a desired position about the casing point and then secured thereto by means of the previously described set screws, following which the other centralizer may be moved over the pin end of the casing joint and oriented rotationally, as shown in FIG. 4, so as to permit the longitudinally extending portions and recesses to be moved into interlocking relation. At this time, the set screws of the second centralizer may be moved into position to secure it in place in end to end relation with respect to the previously mounted centralizer.

In the preferred and illustrated embodiment of the invention, the recesses in each end of each centralizer 20 are of the same depth, and the blades extend from the outer ends of the longitudinally extending portions of the body at one end thereof to the inner ends of the recesses at the other end of the body. Consequently, and as shown in FIG. 5, the blades of the interlocked pair of centralizers extend from substantially one end to the other thereof.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A casing centralizer comprising a circumferentially continuous tubular metal body adapted to fit closely about a joint of casing, and a plurality of solid metal blades fixed to the body and extending parallel to the axis of the body along the outer diameter of the body in generally equally spaced apart relation, each blade having opposite ends which are tapered outwardly toward one another and a relatively wide outer surface for bearing against the well bore or an outer casing in which the casing is disposed, including set screws extending threadedly through holes in at least certain of the blades and the body for gripping the casing so as to hold the centralizer in place.

2. A casing centralizer, comprising a tubular body adapted to fit closely about a joint of casing, and a plurality of blades extending longitudinally along the outer diameter of the body in spaced apart relation and having an outer surface for bearing against a well bore or an outer casing in which the joint of casing is disposed, one end of the tubular body having recesses longitudinally aligned with the spaces between adjacent blades, the other end of the tubular body having recesses longitudinally aligned with the blades, and said recesses and portions of the bodies which extend longitudinally beyond the recesses being of substantially equal width, whereby the longitudinally extending portions of a pair of centralizers may be inserted between the recesses in their adjacent ends in order to rotationally interlock the pair with the spaces between their blades longitudinally aligned.

3. A casing centralizer of the character defined in claim 2, wherein the recesses in each end are the same depth, and the blades extend from the outer ends of longitudinally extending portions of one end of the body to the inner ends of the recesses of the other end.

4. A casing centralizer of the character defined in claim 3, wherein the tubular body and blades are cast as one metal piece.

* * * * *